United States Patent [19]

Kuehling

[11] 4,227,299

[45] Oct. 14, 1980

[54] HAND TOOL FOR TERMINAL CONNECTION OF ELECTRICAL CABLE TO AN ELECTRICAL CONNECTOR

[75] Inventor: Guenter Kuehling, Berwyn, Ill.

[73] Assignee: Bunker Ramo Corporation, Oak Brook, Ill.

[21] Appl. No.: 968,057

[22] Filed: Dec. 11, 1978

Related U.S. Application Data

[63] Continuation-in-part of Ser. No. 935,395, Aug. 21, 1978, abandoned.

[51] Int. Cl.[3] ..... H01R 43/04

[52] U.S. Cl. ..... 29/751; 72/410; 72/465; 81/425 A; 81/426

[58] Field of Search ..... 29/751, 753, 566.3, 29/566.4, 758, 268; 81/425 A, 425 R, 426, 418; 72/410, 465, 466

[56] References Cited

U.S. PATENT DOCUMENTS

| | | | |
|---|---|---|---|
| 198,678 | 12/1877 | Poole . | |
| 2,439,501 | 4/1948 | Yelkin . | |
| 2,488,484 | 11/1949 | Vanderclute | 81/52 |
| 2,755,541 | 7/1956 | Kruger | 29/268 |
| 3,157,075 | 11/1964 | Filia | 29/751 X |
| 3,383,963 | 5/1968 | Vondrachek | 81/423 |
| 3,412,596 | 11/1968 | Burns | 29/753 X |
| 3,487,524 | 1/1970 | Filia | 29/751 |
| 3,599,308 | 8/1971 | Fielder | 29/751 |
| 3,812,743 | 5/1974 | Shat et al. | 81/426 X |
| 4,070,745 | 1/1978 | Schimmelman | 29/268 |

*Primary Examiner*—Carl E. Hall

*Attorney, Agent, or Firm*—F. M. Arbuckle; J. R. Hoffman

[57] ABSTRACT

A hand tool is disclosed for assembling or terminating an electrical cable to a terminal connector or the like which has a receptacle portion for receiving the cable. The hand tool includes a pair of hand operated opposing jaws for movement toward and away from each other. One of the jaws of the tool has a relatively rigid bearing plate defining a bearing surface facing the opposing jaw for engaging the terminal connector. The opposing jaw has a stuffer blade for engaging the cable and driving the cable into the receptacle portion of the connector. A resiliently yieldable backing member is sandwiched between the bearing plate and the one jaw to provide yielding movement therebetween to accommodate variable sized terminal connectors positioned between the jaws and to prevent damage to the electrical cable due to possible excessve pressure being applied when the cable is assembled to the connector. The bearing plate is mounted on the one jaw by a post member securely fixed at one end to the back side of the bearing plate. The post member extends through the yieldable backing member and is connected at its other end to the one jaw by lost motion means to accommodate yielding movement between the bearing plate and the jaw. In one form of the invention, the jaws of the tool form extensions of unitary handles in a plier-type tool. In another form of the invention, the jaws are pivotally connected to separate handle members by toggle-type connections.

21 Claims, 10 Drawing Figures

HAND TOOL FOR TERMINAL CONNECTION OF ELECTRICAL CABLE TO AN ELECTRICAL CONNECTOR

This is a continuation-in-part of my copending United States patent application Ser. No. 935,395, filed Aug. 21, 1978, now abandoned and entitled "Hand Tool For Terminal Connection of Electrical Cable to an Electrical Connector".

BACKGROUND OF THE INVENTION

This invention relates to a hand tool for assembling an electrical cable to a terminal connector.

Certain hand tools of the character described, as well as crimping tools in the field of electrical connectors, commonly include a pair of jaws in a plier-type tool. The jaws may have either a pivotal action for cooperation with one another, or a generally parallel action facilitated by a toggle-type connection. The tool has a pair of handle members pivotally connected to one another and which are pivoted by the operator's hand to effect a connector assembly, crimping or other terminal operation through closing movement of the jaws. The handle members are usually spring biased to their open or separated positions and manipulated by the operator to their closed positions against the spring bias. It is through force exerted by the operator on the handle members that the assembly or termination is effected.

One common method of terminating electrical cables, for instance, insulation clad cables to terminal connectors, is to insert the cables into receiving slots formed in the connectors and which hold the cables in terminate positions. In many instances, the connectors have electrical contact piercing portions or blades which pierce the insulative covering about the cables during assembly or termination of the cables to the connector to establish an electrical conductive path therethrough after the assembly operation. Problems arise when an operator exerts indeterminate force on the handle members of the tool during the aforesaid assembly operation, particularly when excess force is exerted by the operator. Excessive forces can drive the insulation piercing conductive blades into or through the conductive wire portion or core of the cable causing damage to the cable. This could interfere with the electrical properties of the cable. This problem particularly arises when the electrical connectors to which the cables are terminated are of varying sizes for various intended purposes, such as male and female connectors. Without any provision being made for the difference in connector size, the operator can rely only on his feel of the connector to insure that the piercing blades of the connector contacts do not damage or overly cut through the conductor core of the cable.

Attempts have been made to provide a hand tool which has adjusting means which can be set to determine the closing distance of travel of the jaws of the tool depending upon the size of the connector which is to be assembled to the appropriate electrical cable. However, with such manually adjustable tools, the tool requires a separate physical action to set the tool for each size or configuration of connector. It would be desirable, and this invention is directed, to provide a hand tool of the character described for solving these problems in assembling or terminating electrical cables for electrical connectors or the like.

SUMMARY OF THE INVENTION

An object, therefore, of the present invention is to provide a hand tool for assembling or terminating an electrical cable to a terminal connector or the like for accommodating different sizes or configurations of terminal connectors.

Another object of the invention is to provide such a hand tool which automatically accommodates different sized terminal connectors.

These and other objects are accomplished by providing a hand tool for assembling or terminating an electrical cable to a terminal connector or the like which has a receptacle portion for receiving the cable. The tool is in the form of a plier type structure which has a pair of handle-operated opposing jaws for movement toward and away from each other at adjacent ends of handle members which are spring biased to their open or separated positions. The handle operated jaws are manipulated by an operator to their closed positions against the spring bias. The jaws are closed to assemble or terminate the electrical cable to the terminal conductor through force exerted by the operator on the handle members. A bearing plate is mounted on one of the jaws and has a bearing surface facing the opposing jaw for engaging the terminal connector. The other jaw has a stuffer portion or blade for engaging the electrical cable and driving the cable into the receptacle portion of the connector. A resiliently yieldable backing member, in the form of a backing pad, is sandwiched between the bearing plate and the one jaw providing yielding movement therebetween to accommodate variable sized terminal connectors positioned between the jaws, to prevent damage to the electrical cable due to excess pressure applied by an operator when the cable is assembled to the connector. The bearing plate is mounted on its respective jaw by means of a post type member which is rigidly fixed at one end thereof to the bearing plate, extends through the yielding backing member, and is connected to the jaw at the other end of the post member by lost motion means in the form of a pin and slot connection. The slot is formed in the jaw and extends generally in the direction of movement thereof, and the pin is positioned within the slot transversely thereof and extending through the post member. The pin is removable to permit replacement of the bearing plate and/or the yieldable backing member. The stuffer portion or blade on the other jaw is mounted thereon by means of a removable pin so that the stuffer blade can be removed for replacement purposes or for reversal of the stuffer blade.

In one form of the invention, the opposing jaws of the hand tool are connected to the handle members of the tool by a toggle type connection, and in another form of the invention, the jaws form integral extensions of the handle members.

Other objects, features and advantages of the invention will be apparent from the following detailed description taken in connection with the accompanying drawings.

DETAILED DESCRIPTION OF THE INVENTION

Figures 1, 2, 3, 4, 5, 6:
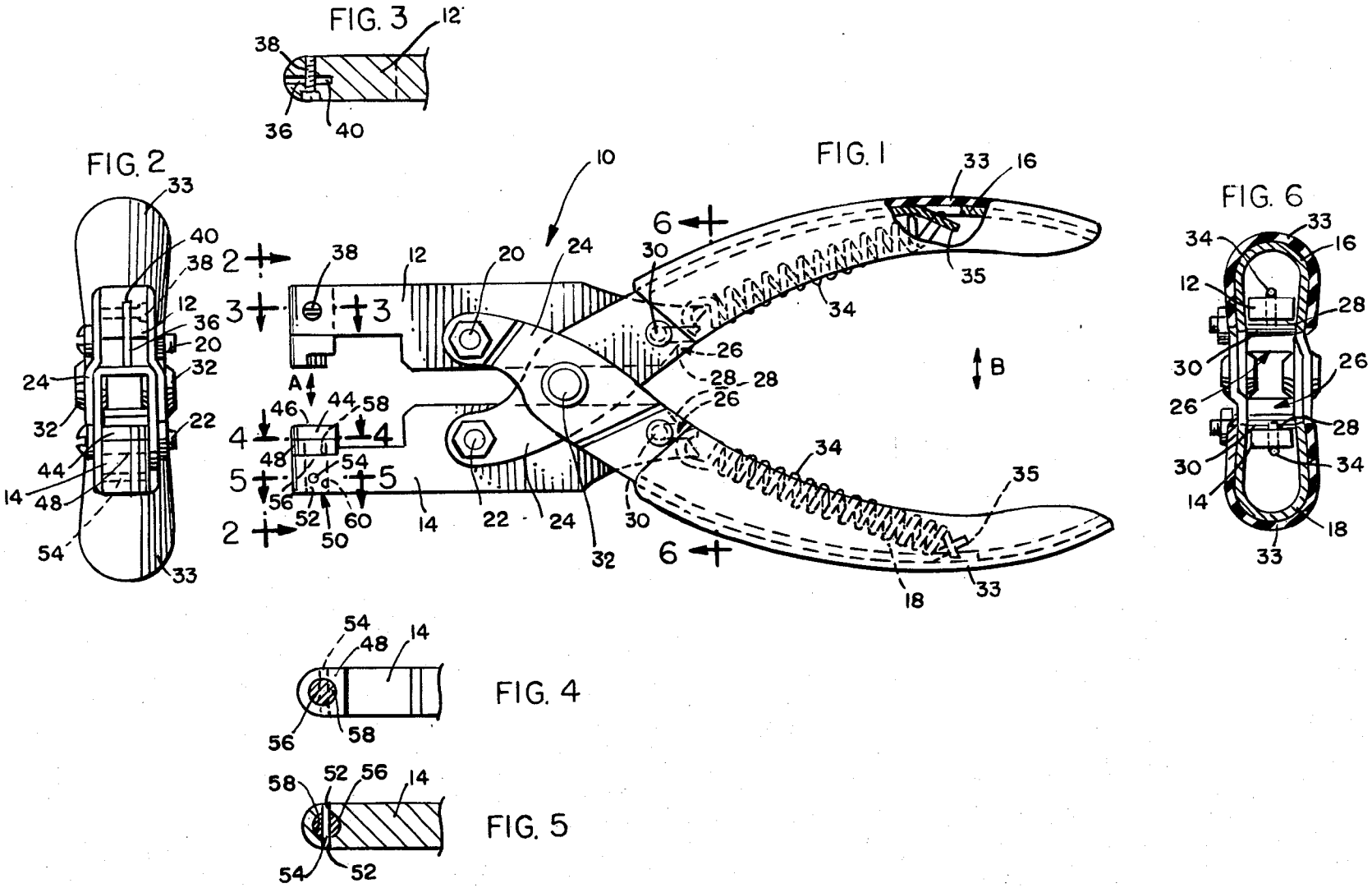
FIG. 1 is a side elevational view of one form of the hand tool of the present invention.
FIG. 2 is an end elevational view taken generally in the direction of arrows 2—2 of FIG. 1.
FIG. 3 is a fragmented horizontal section taken generally along line 3—3 of FIG. 3.
FIG. 4 is a fragmented horizontal section taken generally along line 4—4 of FIG. 1.
FIG. 5 is a fragmented horizontal section taken generally along line 5—5 of FIG. 1.
FIG. 6 is a vertical section taken generally along line 6—6 of FIG. 1.
Figure 8:
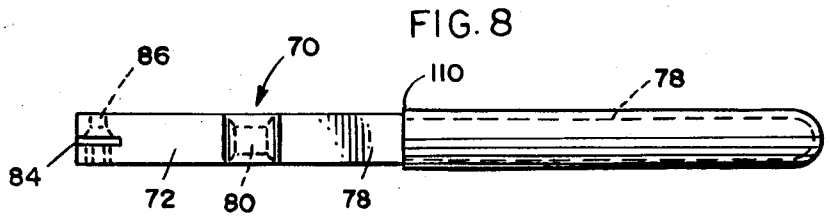
FIG. 8 is a top plan view of the hand tool of FIG. 7.

Referring to the drawings in greater detail, and specifically to the form of the invention shown in FIG. 1; the hand tool of the present invention, generally designated 10, is designed for assembling an electrical cable (not shown) to an appropriate terminal connector (not shown) or the like which has an appropriate receptacle portion for receiving the cable. The cable is conventional and includes an electrical conductor or wire covered by a coating of thermoplastic insulative material or the like. Ribbon cables which include a plurality of such coated conductors connected by a webbing in a planar parallel disposition normally are terminated in an elongated terminal connector which has a plurality of slots extending longitudinally thereof defining receptacles for receiving the multiple cables. A plurality of individual contact members are mounted on the terminal connector in conjunction with each receiving slot and includes conductive piercing blades which cut into or pierce the thermoplastic insulative coating for the cables as the cables are stuffed into the slots to establish the respective electrical connections. In many instances, the cables must be removed and/or replaced individually for repair or other purposes, and the hand tool of the present invention is designed for assembling an individual cable into an individual receptacle portion of the terminal connector. Other similar applications of the hand tool will be apparent from the following detailed description.

The hand tool 10 includes a pair of handle operated opposing jaws 12 and 14 (the upper and lower jaws, respecitvely, shown in FIG. 1) which are fabricated of solid rigid material such as steel, or similar alloy materials. The jaws 12 and 14 are pivotally connected in a toggle arrangement to the ends of channel shaped handles 16 and 18, respectively, by pivot pins 20 and 22, respectively. Each handle 16, 18 has spaced wing-like members 24 disposed at the inner end thereof in a generally parallel spaced disposition sandwiching the jaws 12, 14 therebetween and through which the pivot pins 20, 22 extend. The jaws 12, 14 extend inwardly beyond the pivot pins 20, 22 between the wings 24 of the handles 16, 18 and are connected thereto by a lost motion means, generally designated 26, completing the toggle type connection between the handles and jaws. The lost motion connection 26 for each handle and jaw includes a rearwardly opening slot 28 formed in the inner ends of the jaws 12,14 and through which pivot pins 30 extend for movement lengthwise within the slots 28 of the jaws. The pivot pins 30 are fixed at the ends thereof to the respective handles. As the jaws 12, 14 open and close in the direction of double headed arrow A (FIG. 1) as the handles 16, 18 are operated in the direction of double headed arrow B (FIG. 1), the jaws correspondingly move in a toggle type fashion about pivot pins 20, 22, with the difference between the arcuate paths of movement of the jaws and the handles being accommodated by the relative movement of pivot pins 30 within slots 28.

The handles 16, 18 themselves are pivotally connected together for opening and closing about double headed pivot pins 32 extending through the pairs of wings 24 at the inner ends of the handles. Each handle 16, 18 is covered by an insulative coating or sleeve 33.

The handles 16, 18 are spring biased to their open or separated positions and manipulated by an operator to their closed positions against the spring bias. The spring means includes a pair of elongated coil springs 34 which are secured to their outer ends to tabs 35 on the inside of the handles and at their inner ends to the inner ends of the jaws 12, 14 within the handles 16, 18, respectively.

A stuffer blade 36 is rigidly secured to the inside of the upper jaw 12 by means of a set screw 38, with the stuffer blade disposed within a slot 40 (FIG. 3) formed in the jaw 12. The stuffer blade 36 has a waffle configuration 42 along its exposed edge facing the jaw 14. The waffled edge 42 engages the outer coating or insulation of an electrical cable during the assembly operation of the hand tool to eliminate longitudinal movement of the cable during assembly. The set screw 38 may be loosened to adjust, reverse or replace the stuffer blade 36.

A bearing plate 44 is secured to the lower jaw 14 and has a flat bearing surface 46 facing the stuffer blade 36 in the jaw 12. A resiliently yieldable backing member or cushioning pad 48 is sandwiched between the bearing plate 44 and the jaw 14 providing for yielding movement between the bearing plate and jaw to accommodate variable sized terminal connectors positioned between the jaws 12, 14 to prevent damage to the electrical cable due to excessive pressure which might be applied by an operator of the tool when the cable is assembled or terminated to the connector as further elaborated hereinafter.

A lost motion means, generally designated 50, is provided for connecting the bearing plate 44 to the jaw 14. More particularly, the lost motion means includes a pair of slots 52 formed in the outer or side faces of the jaw 14 and extending generally in the opening and closing direction of movement of the jaws 12, 14 as shown by the double headed arrow A (FIG. 1). A pin 54 extends through the jaw 14 with the opposite ends of the pin disposed within the slots 52. A post like member 56 is rigidly secured at one end thereof (the top end as viewed in FIG. 1) to the underside of the bearing plate 44, extends through a bore 58 in the resiliently yieldable backing member or cushion 48 and through a bore 60 formed in the jaw 14. The pin 54 extends through the post member 56 to mount the bearing plate 44 and the resilient backing member 48 to the jaw 14. This lost motion connection accommodates relative movement between the bearing plate 44 and the jaw 14 as well as compression and expansion of the resilient member 48 during operation of the tool to assemble or terminate an electrical wire to cable to a terminal connector or the like. The pin 54 preferably is removable, as by a press-fit through the post member 56 connected to the bearing plate 44, to permit replacement of the backing member 48 and/or bearing plate 44 and post member 56.

It should be pointed out that the resiliently yieldable backing means of the present invention could be appropriately employed between the stuffer blade 36 and jaw 12 to accommodate differences in the sizes and shapes of various connectors, but the present embodiment of the backing member 48 disposed between the bearing plate 44 and the jaw 14 has proven quite effective.

The yieldable backing member 48 is fabricated of a resilient material depending upon the material of the insulative coating of the particular type of electricl cable employed with the hand tool 10 of the present invention, so that the yieldable backing member 48 provides a sufficient back-up for the bearing plate 40 whereby the piercing blades of the contact which is mounted on the terminal connector can cut through or pierce the outer insulative coating of the cable to establish an electrical connection. However, the yieldable backing member 48 should be sufficiently resilient to prevent the piercing blades of the contact from cutting through or damaging the conductive wire of the cable. In practice, a synthetic rubber material for the backing member 48 of approximately 80 durometer has proven effective for many insulation clad cables, to permit the insulative covering of the cable to be pierced by the contact blades, but to prevent the wires of the cables to be damaged by the contact piercing blades.

Figure 7:
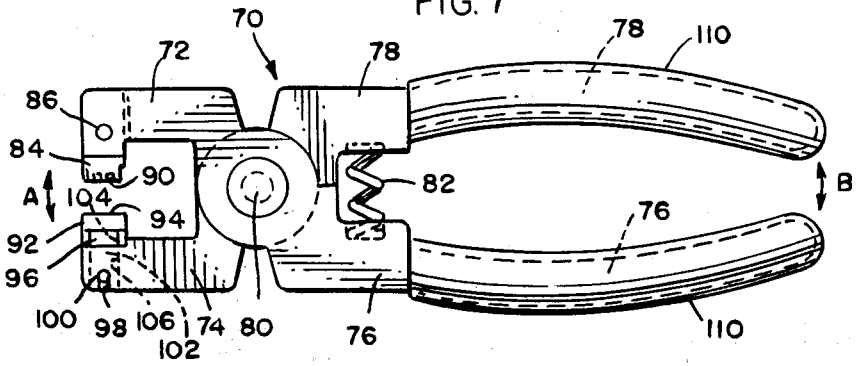
FIG. 7 is a side elevational view of another form of the hand tool of the present invention.
Figure 10:
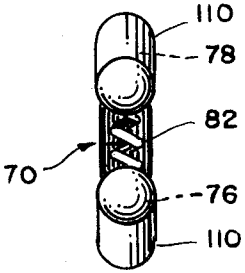
FIG. 10 is an end elevational view looking toward the right end of the tool shown in FIG. 7.
Figure 9:
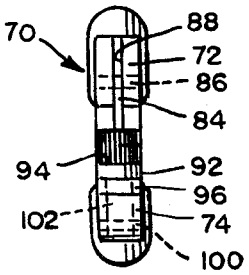
FIG. 9 is an end elevational view of the hand tool of FIG. 7, looking toward the left of the tool shown in FIG. 7.

Referring to the form of the invention shown in FIGS. 7 through 10, a hand tool, generally designated 70, is shown to include a pair of handle operated opposing jaws 72 and 74 (the upper and lower jaws, respectively, shown in FIG. 7). The jaws are fabricated of solid rigid material, such as steel or similar alloy materials, and form unitary extensions of handle members 76 and 78 for the jaws 72 and 74, respectively. The jaws 72, 74 and the handle members 76, 78 are pivoted together by a single pivot pin 80 to form a plier-type tool whereby the jaws move toward and away from each other generally in the direction of double headed arrow A (FIG. 7) and the handle members moved toward and away from each other generally in the direction of double headed arrow B (FIG. 7). A coil spring 82 is disposed, under compression, between the handle members 76 and 78 to bias the hand members and jaws outwardly toward their open or separated positions.

A stuffer blade 84, similar to the stuffer blade 36 shown in FIGS. 1–6, is rigidly secured to the inside of the upper jaw 72 by means of a set screw or pin 86. The stuffer blade 84 is disposed within a slot 88 (FIG. 9) formed in the jaw 72. The stuffer blade 84 has a waffle configuration 90 along its exposed edge facing the jaw 74. As with the stuffer blade 36 shown in FIGS. 1–6, the waffled edge engages the outer coating or insulation of an electrical cable during the assembly or termination operation of the hand tool to eliminate longitudinal movement of the cable during assembly. The set screw or pin 86 may be loosened to adjust, reverse, or replace the stuffer blade 84.

A bearing plate 92, similar to the bearing plate 44 shown in FIGS. 1–6, is secured to the lower jaw 74 and has a flat bearing surface 94 facing the stuffer blade 84 in the jaw 72. A resiliently yieldable backing member or cushioning pad 96, similar to the backing member 48 in FIGS. 1–6, is sandwiched between the bearing plate 92 and the jaw 74 providing for yielding movement between the bearing plate and jaw to accommodate variable sized terminal connectors positioned between the jaws to prevent damage to the electrical cable due to excessive pressure which might be applied by an operator of the tool when the cable is assembled or terminated to the connector, as elaborated in relation to the form of the invention shown in FIGS. 1–6.

A lost motion means similar to that shown in FIGS. 1–6, is provided for connecting the bearing plate 92 to the jaw 74 and includes a pair of slots 98 formed in the outer or side faces of the jaw 74 and extending generally in the opening and closing direction of movement of the jaws as shown by the double headed arrow A (FIG. 7). A pin 100 extends through the jaw 74 with the opposite ends of the pin disposed within the slots 98. A post-like member 102 is rigidly secured at one end thereof (the top end as viewed in FIG. 7) to the underside of the bearing plate 92, extends through a bore 104 in the resiliently backing member or cushion 96, and through a bore 106 formed in the jaw 74. The pin 100 extends through the post member 102 to mount the bearing plate 92 and the resilient backing member 96 to the jaw 74. This lost motion connection accommodates relative movement between the bearing plate 92 and jaw 74 as well as compression and expansion of the resilient member 96 during operation of the tool to assemble or terminate an electrical wire or cable to a terminal connector or the like. The pin 100 is removable, as by a press-fit through the post member 102 to permit replacement of the backing member 96 and or bearing plate 92 and post member 102.

As mentioned hereinbefore, it should be pointed out that the resiliently yieldable backing means defined by the backing member or pad 96 could be appropriately employed between the stuffer blade 84 and the jaw 72, but the present embodiment of the backing member 96 disposed between the bearing plate 92 and the jaw 74 has proven quite effective. In addition, each of the handles 72, 78 is covered by an insulative coating or sleeve 110.

While a particular embodiment of the present invention has been shown and described, it is apparent that various changes and modifications may be made, and it is therefore intended in the following claims to cover all such modifications and changes as may fall within the true spirit and scope of this invention.

I claim:

1. A hand tool for assembling an insulated electrical cable to a terminal conductor or the like which has a receptacle portion and an insulation piercing contact for receiving the insulated cable, comprising: a pair of handle operated opposing jaws for movement toward and away from each other, one of said jaws having means defining a bearing surface for engaging the terminal connector, and the other jaw having a stuffer portion for engaging the cable and inserting the cable into the insulation piercing contact in the receptacle portion of the connector, and means defining a resiliently yieldable backing member in the form of a cushion pad on at least one of said jaws between the jaw and the respective bearing surface or the stuffer portion providing yielding movement therebetween to accommodate variable sized terminal connectors positioned between the jaws and to prevent damage to the electrical cable due to excess pressure applied when the cable is assembled to the connector, said cushion pad being fabricated of a material providing sufficient back-up to permit the contact to pierce the insulation of the cable but being sufficiently resilient to prevent the contact from damaging the conductive wire of the cable.

2. The hand tool of claim 1 including means for removably mounting said yieldable backing member on said one jaw.

3. The hand tool of claim 1 including lost motion means connecting the respective surface means or the stuffer portion to said one jaw to accommodate said yielding movement therebetween.

4. The hand tool of claim 3 wherein said lost motion means comprises a pin and slot construction, the slot extending generally in the direction of movement of said jaws.

5. The hand tool of claim 1 including means on said hand operated jaws for biasing the jaws to an open position.

6. The hand tool of claim 1 wherein said bearing surface means comprises a bearing plate mounted on said one jaw with said bearing surface facing the opposing jaw, and said resiliently yieldable backing member is sandwiched between the bearing plate and said one jaw.

7. The hand tool of claim 6 wherein said bearing plate is mounted to said one jaw by means extending through said yieldable backing member.

8. The hand tool of claim 6 including lost motion means connecting the bearing plate to said one jaw to accommodate yielding movement therebetween.

9. The hand tool of claim 8 wherein said bearing plate is mounted to said one jaw by means extending through said yieldable backing member.

10. The hand tool of claim 9 wherein said last named means is connected to said one jaw by said lost motion means.

11. The hand tool of claim 10 wherein said lost motion means comprises a pin and slot construction, the slot extending generally in the direction of movement of said jaws.

12. The hand tool of claim 11 wherein said pin is selectively removable for placement of said resilient backing member and/or said bearing plate.

13. The hand tool of claim 1 including a pair of handle members for said jaws, providing a plier-type tool, said jaws being pivotally connected to said handle members by toggle type connections.

14. The hand tool of claim 1 including a pair of handle members for said jaws, providing a plier-type tool, said jaws forming integral extensions of said handle members.

15. The hand tool of claim 1 wherein said cushion pad is fabricated of synthetic rubber, or like material.

16. A hand tool for assembling an insulated electrical cable to a terminal connector or the like which has a receptacle portion and an insulation piercing contact for receiving the cable, comprising: a pair of handle operated opposing jaws for movement toward and away from each other, one of said jaws having means defining bearing surface means for engaging the terminal connector and the other jaw having a stuffer portion for engaging the cable and inserting the cable into the insulation piercing contact in the receptacle portion, said bearing surface means comprising a bearing plate mounted on said one jaw with said bearing surface facing the opposing jaw, the bearing plate being fabricated of generally rigid material, a resiliently yieldable backing member in the form of a cushion pad sandwiched between said bearing plate and said one jaw providing yielding movement therebetween to accommodate variable sized terminal connectors positioned between the jaws and to prevent damage to the electrical cable due to excess pressure applied when assembling the cable to the connector, said cushion pad being fabricated of a material providing sufficient back-up to permit the contact to pierce the insulation of the cable but being sufficiently resilient to prevent the contact from damaging the conductive wire of the cable, said bearing plate and said yieldable backing member being mounted to said one jaw by a post member rigidly secured at one end to said bearing plate and extending through said yieldable backing member, and lost motion means connecting the other end of said post member to said one jaw to accommodate yielding movement of said bearing plate relative to said one jaw.

17. The hand tool of claim 16 wherein said lost motion means comprises a pin and slot construction between said other end of the post member and said one jaw, the slot extending generally in the direction of movement of said jaws.

18. The hand tool of claim 17 wherein said pin is selectively removable for replacement of said resilient backing member and/or said bearing plate.

19. The hand tool of claim 16 including a pair of handle members for said jaws, providing a plier-type tool, said jaws being pivotally connected to said handle members by toggle type connections.

20. The hand tool of claim 16 including a pair of handle members for said jaws, providing a plier-type tool, said jaws forming integral extensions of said handle members.

21. The hand tool of claim 15 wherein said cushion pad is fabricated of synthetic rubber, or like material.

* * * * *